US009643197B2

(12) United States Patent
Bellandi

(10) Patent No.: US 9,643,197 B2
(45) Date of Patent: May 9, 2017

(54) DEVICE INTRODUCED INTO DROPLET SPRAYING TIP

(71) Applicant: GUARANY INDUSTRIA E COMERCIO LTDA., Itu (BR)

(72) Inventor: Carlos Alberto Fleury Bellandi, Itu (BR)

(73) Assignee: Guarany Industria E Comercio LTDA., Itu-SP (BR)

( * ) Notice: Subject to any disclaimer, the term of this patent is extended or adjusted under 35 U.S.C. 154(b) by 487 days.

(21) Appl. No.: 13/720,046

(22) Filed: Dec. 19, 2012

(65) Prior Publication Data

US 2013/0105600 A1 May 2, 2013

Related U.S. Application Data

(63) Continuation of application No. 12/961,860, filed on Dec. 7, 2010, now abandoned.

(30) Foreign Application Priority Data

Dec. 21, 2009 (BR) ..... 8902848 U

(51) Int. Cl.

| | |
|---|---|
| ***B05B 7/24*** | (2006.01) |
| ***B05B 7/00*** | (2006.01) |
| *B05B 7/04* | (2006.01) |

(52) U.S. Cl.

CPC ..... *B05B 7/24* (2013.01); *B05B 7/0075* (2013.01); *B05B 7/0441* (2013.01)

(58) Field of Classification Search

CPC ..... B05B 7/0441; B05B 7/045; B05B 7/0491; B05B 7/12; B05B 7/2402; B05B 7/2405; B05B 7/2416; B05B 7/2424; B05B 7/2435; B05B 9/08; B05B 9/0888; B05B 7/24; B05B 7/0075

USPC ..... 239/154, 289, 340, 344, 354, 369, 371, 239/423, 424

See application file for complete search history.

(56) References Cited

U.S. PATENT DOCUMENTS 2,609,233 A * 9/1952 Stearman ..... A01M 7/0003 239/351

7,559,490 B2 7/2009 Rappin

* cited by examiner

*Primary Examiner* — Christopher Kim

(74) *Attorney, Agent, or Firm* — Duane Morris LLP

(57) ABSTRACT

A device configured for clamping onto the discharge tube of a powered air blower has a projecting control element containing a filter and interchangeable color-coded valve parts for selecting a rate of fluid discharge. Fluid is discharged into the air flow at a first air flow constriction (venturi) that leads into a second air flow constriction for developing aerosol droplet sizes (<50 μm). The device is useful with backpack equipment for controlling disease vector insects in inaccessible areas.

11 Claims, 3 Drawing Sheets

DEVICE INTRODUCED INTO DROPLET SPRAYING TIP

CROSS REFERENCE TO RELATED APPLICATION

This application is a continuation of co-pending application Ser. No. 12/961,860, filed Dec. 10, 2010, and claims Paris Convention priority of BR application MU8902848-1, filed Dec. 21, 2009.

BACKGROUND

Field of the Invention

The invention concerns portable apparatus for discharging an air flow containing fluid droplets.

A device clamps onto the end of a discharge tube of a powered blower and discharges a fluid into the air flow. The fluid passes through a filter, an interchangeable flow limiting valve, and two successive constrictions.

The device provides for the control of flow, distribution and formation of spray droplets, within a size range considered as aerosols (<50 μm), specially aiming the control of current vector insects which transmit human disease epidemics and, manufactured for the assembly on powered backpack equipment for spraying/atomizing liquids, in such a way to allow the application in closed and difficult access areas, where motor vehicles are not able to arrive.

The device features, in its inner part, in the central part of the nozzle, a first constriction (venturi) which, through low pressure, allows the suction of the liquid leading into a next constriction where droplets are formed by disrupting the liquid surface tension in contact with the air stream.

Description of the Prior Art

In the current state of the art, several devices containing spray tips and nozzles are known.

The control of vector insects which transmit human diseases is a basic need in public health and, due to the possibility of epidemic outbursts of these insects, there must be control methods promptly available which allow a quick application, in an economic way and with elevated control efficacy.

The chemical control through the application of liquids delivered in the form of droplets is one of the most used methods for suppressing these insects. Within this method, the determination of the optimum size of the spray droplets and the use of equipment producing droplets within a narrow size range for the specific target will increment the biological efficacy of the pesticides, reduce the doses of the chemical products required and thus will minimize the environmental contamination.

Among the components of a spraying equipment, whether manual or powered, on land as well as aerial, the spraying tip is one of the main components, since they help in the determination of the outlet flow of the applied solution, are responsible for the way of delivery of the liquid and the size of droplets generated in the spraying process. There are different types of tips, and they are classified according to the main energy source utilized for the liquid spraying, which may be hydraulic, when the liquid is sprayed under pressure, or pneumatic, when the liquid is sprayed by action of a gas or steam, or even centrifugal, when the energy of a revolving mechanism is used, among others.

Currently a great variety of spraying tips which utilize the pneumatic method for generation of droplets is known, but few of them achieve them in the form of aerosols (<50 μm), due to design deficiencies, both in the dimensioning and in the adequate harmonization with the other components of a spraying equipment, such as for example, the fan or air blower, common in backpack sprayers, which must generate an adequate air flow for the formation of droplets.

The pneumatic backpack sprayers for use in public health in the control of epidemics of insects transmitting diseases (such as dengue, malaria and yellow fever), require application of insecticides in the form of aerosols, in ultra low volume (ULV) and low volume (LV), which makes the droplets keep in suspension for a determined period, so that the insects may get in contact and absorb such droplets, since larger droplets are not absorbed by these insects due to their minute size. So, droplets in the aerosol range size have a direct consequence on the biological efficacy of the application.

Several powered backpack sprayers can be found in the market, which utilize a compressor, fan, or spinning blowers, generating a gas or air stream for splitting a liquid in the form of droplets, released from the end of a discharge tube. Powered backpack sprayers throw sprays horizontally at distances of 9 to 12 meters and vertically at 6 to 9 meters, but the performance of individual machines vary, depending on the engine and fan size and, the design efficiency.

The spraying tip is a key point in the efficiency of this design, and a large number of the ones existing in the market present the deficiency of lacking an elevated homogeneity in the spectrum of droplet size, within the adequate range for spatial treatments, in the control of flying vectors (<50 μm). And the types of tips which feature this homogeneity, which are the sprayers of the revolving type (revolving discs), generally show a limited dispersion of droplets, thus interfering with the efficiency when trying to reach difficult access sites, such as for example, in constructions, a common situation in public health applications.

Other places of spraying are equally known by the current art. Normally, means are used for constricting the passage of air, for spraying a liquid, by air induction, aiming to reduce the spray drift, which is the action of the wind on the droplets. Many of these known mechanisms use droplets sized not less than 150 microns, differently from the object of the present model.

Other mechanisms use Venturi type nozzles, but for spraying the droplets of liquids such as crops protection products, insecticides, among others, they feature complex constructions, with a great number of components, channels, holes, of difficult access and maintenance.

SUMMARY OF THE INVENTION

For solving the inconveniences of the current art, the present model discloses a device introduced through a tip for spraying droplets, which innovates by providing an adequate spectrum of droplets for the control of vector insects and having an ample dispersion of the spray flow, as a consequence of its design, in which it utilizes a Venturi type structure, where the high-speed air flow inside a determined size tube reaches a reduced-size hole inside this tube. This passage constriction considerably elevates its speed, thus making the pressure be reduced at this point (low pressure zone) and providing the suction of the liquid to be sprayed (by placing an inlet for liquid above this low pressure area).

The falling of a liquid under low pressure on a high-speed air flow disrupts the liquid surface tension and, consequently, forms droplets of adequate dimension for spatial applications (<50 μm).

The spraying tip also presents the advantage of having a compact body, promptly adaptable to the discharge tube of the powered backpack equipment, for application of liquids of aqueous or oily formulations.

The present model discloses a device introduced into a tip for spraying droplets, which provides for the control of the flow, distribution and formation of spray droplets, within the spectrum of droplet sizes considered as aerosols (<50 μm), specially aiming the control of the current vector insects which transmit human disease epidemics and, manufactured for assembly on powered backpack equipment for spraying/atomizing liquids, in such a way to allow the application in closed and difficult access areas, where motor vehicles are not able to arrive.

The present model comprises a body which has in its inner part, in the central region, a tip, of geometry of the venturi type, configuring an area for constriction to the passage of air flow, linked to the cylindrical casing and a second low pressure chamber, and the geometry of the tip causes the increase in the speed of the air flow and the consequent reduction in the pressure, thus causing the suction of the liquid and the formation of the droplets by the disruption of the surface tension when the air stream is passed through said tip.

BRIEF DESCRIPTION OF THE DRAWINGS

The objects of the invention will be better characterized based on the attached figures, wherein.

DETAILED DESCRIPTION

Figure 1:
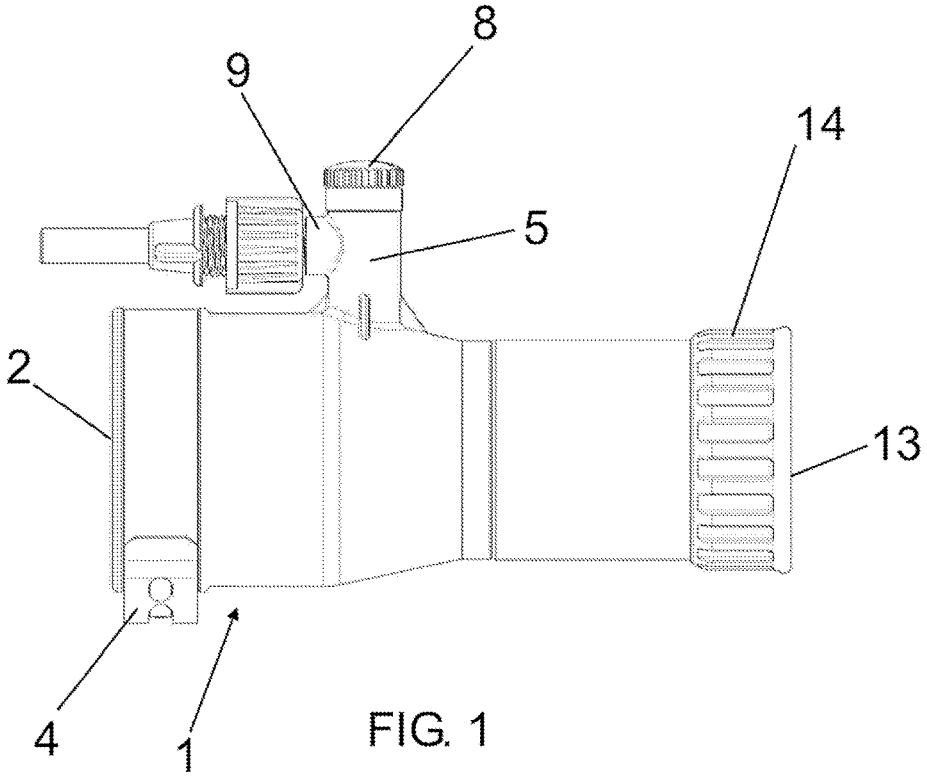
FIG. 1 is a front view of the tip for spraying droplets according to an embodiment of the invention.
Figure 2:
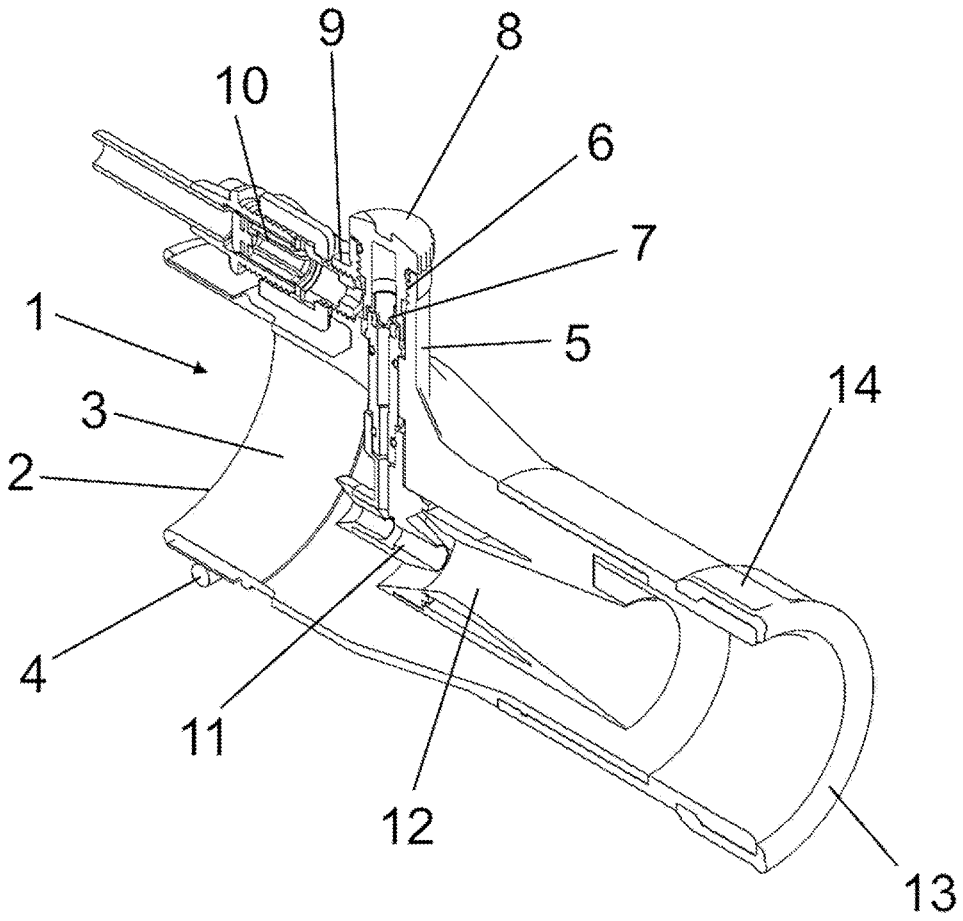
FIG. 2 is a perspective view in longitudinal cut of the spraying tip according to an embodiment of the invention.
Figure 3:
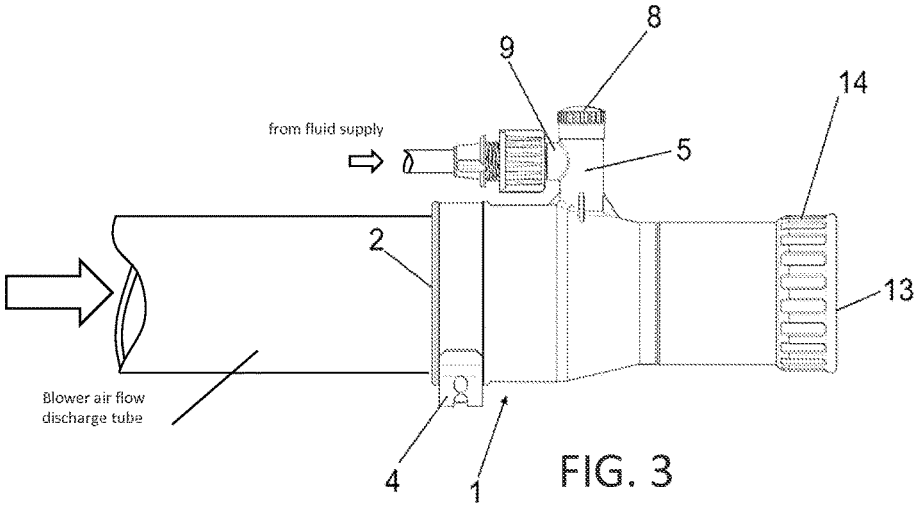
FIG. 3 is an elevation view showing the apparatus coupled to a blower air flow discharge tube.

According to FIGS. 1, 2 and 3, it is observed that the present model comprises a body (1), which has in its rear end (2) a circular main part (3), around which a clamp (4) is fastened, and the circular main part (3) adapts and couples to the air flow discharge tube of a sprayer such as a powered backpack equipment and the clamp (4) promotes the fixation to the body (1) at the discharge tube of the sprayer.

From the body (1), a cylindrical casing (5) projects vertically with the threaded upper end (6), and said casing (5) receives in its inner part a pad (7) with a central hole of a controlled diameter, through which the fluid to be applied by the sprayer nozzle runs off.

Said pad (7) remains retained and positioned in the inner part of the casing (5) by means of a pad holder (8), which can be screwed at the upper end (6) of said casing (5).

The set comprised of pad (7) and pad holder (8) configures a device for limiting flow, which enables the application of liquids as needed. This set is interchangeable and identified by colors according to the corresponding desired flow. Different flow values are achieved through the replacement of the set comprised of pad holder (8) and pad (7). This system has the advantage of the operator identifying the flow which is being applied by viewing the color of the pad holders (8).

From the casing (5) a second casing (9) projects horizontally, with a threaded inner part, said inner part which accommodates a filter (10), interchangeable, which may be of several types of mesh and which receives the fluid to be sprayed by the tip.

The body (1) of the nozzle has in its inner part, in the central region, a tip (11), of a geometry of the venturi type, configuring an area of constriction to the passage of the air flow, linked to the cylindrical casing (5).

The geometry of the tip (11) causes the increase in the speed of the air flow and the consequent reduction of the pressure, thus causing the suction of the liquid and the formation of droplets by disruption of the surface tension when the air stream is passed through said tip (11).

The tip (11) connects to a second low pressure chamber (12), where the subdivision into droplets in the pneumatic process occurs, by the impact of the liquid under low pressure with the high-speed air stream, thus causing its spraying and better efficiency in the formation of droplets with size smaller than 50 μm.

At the front end (13), the body (1) has a cast cylindrical extension (14), which acts as a protection to the tip and involves the second low pressure chamber (12). The aim of the extension (14) is to protect the tip against eventual shocks and impacts on its components.

The invention claimed is:

1. An apparatus for discharging an air flow containing droplets of a fluid, comprising:

a blower having an air flow discharge tube; and a body configured to be fastened to the air flow discharge tube of the blower, the body having a circular part at an inlet end thereof;

a first casing projecting from the body and a second casing projecting from the first casing, wherein the first casing has a pad holder threaded on an end of the first casing, the pad holder holding a pad for limiting flow of the fluid into the body, the first casing and the second casing connecting a fluid supply to a venturi in a central region of the body, the venturi forming a constriction for passing an air stream therethrough with an increase in flow speed and reduction in pressure, at the constriction leading to suction of the fluid into the venturi, wherein the venturi leads to a chamber, and the venturi has a smaller outer diameter than an inner diameter of the chamber at a discharge end of the venturi, the venturi and the chamber are separate structures concentrically located within the body, so as to provide a first air passage around the venturi between the venturi and the chamber, and a second air passage between the chamber and body, the chamber having a section with a diameter that increases continuously along a longitudinal direction of the body, the section having a length longer than a length of the venturi in the longitudinal direction, the section terminating at a front end of the chamber, the chamber configured for causing spraying of the fluid in the air stream during operation.

2. The apparatus of claim 1, further comprising a cylindrical extension of the body, at the front end of the body, for protecting the body and the chamber, the cylindrical extension having a diameter that is greater than a maximum diameter of the chamber throughout the cylindrical extension.

3. The apparatus of claim 1, wherein the first casing projects vertically from the body, said first casing having a hole of controlled diameter, through which the fluid flows into the body.

4. The apparatus of claim 1, wherein the air flow discharge tube of the blower is a discharge of a powered backpack sprayer.

5. The discharge apparatus of claim 4, further comprising a clamp configured for fixation of the body to the discharge of the powered backpack sprayer.

6. The discharge apparatus of claim 3, wherein the pad and the pad holder are a set that limits the flow of the fluid into the body to a corresponding desired flow.

7. The discharge apparatus of claim 6, wherein the pad and the pad holder are interchangeable with at least one additional set of a pad and pad holder that limits the flow of the fluid into the body to a different corresponding desired flow.

8. The discharge apparatus of claim 1, wherein the venturi and the chamber are configured to produce droplets with a size smaller than 50 μm.

9. The discharge apparatus of claim 1, wherein the body and the venturi are arranged horizontally, and the first casing is arranged vertically at a location where the first casing is linked to a side wall of the venturi, so that fluid from the casing enters the venturi in a direction that is vertical to a direction of air flow through the body.

10. The apparatus of claim 9, wherein the venturi has an entry for fluid from the casing in a side wall of the venturi.

11. The apparatus of claim 10, wherein the entry for fluid is at an interior part of the venturi, remote from the location where fluid exits the venturi.

* * * * *